US005144798A

United States Patent [19]

Kojima et al.

[11] Patent Number: 5,144,798

[45] Date of Patent: Sep. 8, 1992

[54] REGENERATIVE PARTICULATE TRAP SYSTEM FOR EMISSION CONTROL

[75] Inventors: Akikazu Kojima, Gamagori; Shinji Miyoshi; Mitsuo Inagaki, both of Okazaki, all of Japan

[73] Assignee: Nippon Soken, Inc., Nishio, Japan

[21] Appl. No.: 792,200

[22] Filed: Nov. 13, 1991

[30] Foreign Application Priority Data

Nov. 14, 1990 [JP] Japan ..... 2-306084

[51] Int. Cl.[5] ..... F01N 3/02

[52] U.S. Cl. ..... 60/303; 55/466; 55/523; 55/DIG. 30

[58] Field of Search ..... 60/303; 55/466, 523, 55/DIG. 30

[56] References Cited

U.S. PATENT DOCUMENTS 4,373,330 2/1983 Stark ..... 60/311
4,512,786 4/1985 Sakurai ..... 55/DIG. 30
4,516,993 5/1985 Takeuchi ..... 55/DIG. 30
4,872,889 10/1989 Lepperhoff ..... 60/303

FOREIGN PATENT DOCUMENTS 58-106115 6/1983 Japan .
124012 7/1983 Japan ..... 60/303
90713 5/1984 Japan ..... 60/288
60-38018 11/1985 Japan .
60-125715 11/1985 Japan .

*Primary Examiner*—Douglas Hart
*Attorney, Agent, or Firm*—Cushman, Darby & Cushman

[57] ABSTRACT

A particulate trap filter is provided with an electric heater for burning out particulates accumulated therein. The electric heater is provided as a wiring pattern such that a higher power efficiency is provided for the portion corresponding to the portion of the filter located away from the center of the filter and a relatively lower power efficiency is provided for the portion corresponding to the central portion of the filter.

11 Claims, 7 Drawing Sheets

REGENERATIVE PARTICULATE TRAP SYSTEM FOR EMISSION CONTROL

BACKGROUND OF THE INVENTION

1. Field of the Invention

The present invention relates to an exhaust gas purification system for trapping carbon and other particulates in an exhaust gas of a diesel engine. More particularly, the invention relates to a particulate trap system for an exhaust gas, by which a filter for trapping particulates, such as a ceramic filter, can be regenerated.

2. Description of the Related Art

In an exhaust passage of a diesel engine, an exhaust gas purification system or an emission control system is provided for trapping particulates, such as carbon particles and so forth, as an anti-pollution measure. An example of such an exhaust gas purification system is illustrated in FIG. 7.

In FIG. 7, a particulate trap system 14 is connected to an exhaust pipe 12 of a diesel engine 10, and a particulate trap filter 16 is disposed inside the particulate trap system 14. The particulate trap filter 16 is formed as a porous ceramic cylinder having a honeycomb structure, and defines a plurality of upstream side passages **16*a* and downstream side passages 16*b* separated by porous partitions 18, as shown in FIG. 8. The downstream ends and the upstream ends of the upstream side passages 16*a*, and the downstream side passages 16*b*, are closed respectively, and accordingly, the exhaust gas from the diesel engine 10 flows into the purification system 14 through upstream side open ends of the upstream side passages 16*a*. The gaseous component of the exhaust gas then passes through the porous structure of the porous partitions 18 into the adjacent downstream side passages 16*b*, and is then subsequently discharged. The particulates, such as carbon particles, contained in the exhaust gas are blocked by the partition 18, and thus are trapped and accumulated in the upstream side passages 16*a***.

Nevertheless, an increase of the amount of accumulated particulates causes an increase in the resistance to the exhaust gas flow, to thus increase the pressure difference $\Delta p$ between the upstream end and the downstream end of the particulate trap filter 16, which may lower the output of the engine 10. Therefore, it is necessary to periodically remove the accumulated particulates, and accordingly, an electronic heater 20 is provided on the upstream side wall surface, for heating and burning the trapped particulates, to thereby regenerate the particulate trap filter.

In FIGS. 7 and 8, 22 denotes a filter casing forming the outer shell of the purification system 14, 24 denotes a bypass passage for allowing the exhaust gas to bypass the purification system 14, and 26 denotes a bypass valve for selectively switching the exhaust gas flow path.

During the regeneration process, heat generated by the burning of the particulates in the vicinity of the outer periphery of the particulate trap filter 16 can escape to the atmosphere, through the filter casing 22, and this can cause a lowering of the temperature of the particulates to lower than the burning temperature thereof, and thus unburnt particulates remain and the regeneration treatment is only partially successful.

FIG. 9 shows local temperature variations during the regeneration treatment, to represent the above-mentioned condition of remaining unburnt particulate. In FIG. 9, the solid line shows temperature variations according to a processing time at the center portion A of the particulate trap filter 16 (for example, in the region A in FIG. 8), and the broken line shows temperature variations according to the processing time at the outer circumferential portion B away from the center (for example, at the region B in FIG. 8). Due to the increase in the difference (temperature difference $\Delta T1$) between the peak values of the two curves, the amount of unburnt particulates at the outer circumferential portion B is increased. Also, when the temperature at the central portion A of the filter 16 becomes much higher than that at the outer circumferential portion B, the filter may be destroyed by a substantial thermal distortion thereof.

SUMMARY OF THE INVENTION

Therefore, an object of the present invention is to provide a regenerative particulate trap system for an exhaust gas, by which the above-mentioned problems in the prior art are solved and an effective regeneration over the whole area of a particulate trap filter is obtained by preventing an incomplete regeneration due to the outer circumferential portion thereof.

Another object of the present invention is to reduce the temperature gradient between the center portion and the outer circumferential portion of the particulate trap filter, and thus prevent a destruction of the filter due to an excessive thermal distortion thereof.

A further object of the present invention is to reduce the electric power consumped by an electric heater used for the regeneration of the particulate trap filter, to thus reduce the load on a power source such as a battery.

To accomplish above-mentioned and other objects, a particulate trap system for an exhaust gas, according to the present invention, includes an electric heater for burning particulates accumulated in a particulate trap filter. The electric heater is arranged in such a manner that it provides a higher power efficiency at a portion away from the center of the trap filter relative to that at a portion close to the center.

According to one aspect of the invention, a particulate trap system for an exhaust emission control comprises:

a particulate trap filter disposed within a passage of an exhaust gas of an engine, for trapping particulates in the exhaust gas of the engine; and an electric heater arranged on a part of the particulate trap filter, for removing accumulated particulates by burning same;

the electric heater being arranged in such a manner that it provides a higher power efficiency at a portion away from the central position of the filter, than the power efficiency provided at the central portion.

In a preferred construction, the portion of the electric heater having a higher power efficiency includes sections of heating wire buried in plugs, for defining the exhaust gas flow path, and the portion of the electric heater having the lower power efficiency includes sections of the heating wire which are bent and inserted to the inlet portion of the exhaust gas flow path.

The particulate trap filter may have circular end face, in which the portion of the filter located away from the center, and having the portion of the electric heater providing a higher power efficiency, and the portion of the filter located at the center and having the portion of the electric heater providing a lower power efficiency are arranged in an essentially concentric manner. Alternatively, the particulate trap filter may have an oval or elliptic end face configuration, in which the portion of the filter having portions of the electric heater providing a higher power efficiency are located at both ends along the longer axis of the filter, and the portion of the filter having the portion of the electric heater providing a lower power efficiency is located therebetween.

In another preferred construction, the particulate trap filter may be provided with a higher particulate trapping efficiency at the portion away from the center, and a lower particulate trapping efficiency at the central position, by differing the patterns used for closing the passage by the plug.

According to another aspect of the invention, a particulate trap filter for an emission control system comprises:

a plurality of porous partitions disposed in a path of an exhaust gas from an engine and carrying particulates, the partitions defining a plurality of exhaust gas passages for passing the exhaust gas therethrough;

a first plug means for selectively closing one ends of the exhaust gas passages defined by the partitions;

a second plug means for closing the other ends of the exhaust gas passages, which are held open at the one ends, to thereby form an exhaust gas path across the porous partitions for trapping particulates, carried by the exhaust gas, in the partitions;

a heating means having portions buried in the first plug means to be fixed to one end of the exhaust gas passage, for heating and burning out particulates accumulated in the exhaust gas passages, the depths to which the portions of the heating means are burned being deeper at the portion of the filter away from the center, than at the central portion.

By arranging the electric heater in a pattern as set forth above, a greater heat energy can be provided at the outer peripheral portion, from which the heat can easily escape, to ensure and maintain the burning of the particulates,to thereby fully regenerate the filter.

Further, since the central portion can maintain the heat and does not require a large heat capacity to maintain the burning of the particulates, the amount of heat generated is limited by providing a lower power efficiency, to thus reduce the power consumption and prevent overheating.

Accordingly, since the temperature at the outer circumferential portion becomes higher, to thereby reduce the temperature gradient between that portion and the central portion, possibility of a destruction of the filter due to a large thermal distortion can be successfully avoided.

BRIEF DESCRIPTION OF THE DRAWINGS

The present invention will be more fully understood from the detailed description given herebelow, and from the accompanying drawings of the preferred embodiments of the invention. Note that the specific embodiments are for the purpose of explanation and illustration only, and in no way limit the present invention.

In the drawings:

FIGS. 1 and 2 show a first embodiment of a particulate trap system for an exhaust gas according to the present invention, in which FIG. 1 is a diagram showing a pattern of an arrangement of a heater in a particular trap filter having a circular configuration, and FIG. 2 shows a practical arrangement of the heater, by partially enlarged perspective views shown in FIGS. 2(*a*) and (*b*);

FIGS. 7 and 8 show the prior art, in which FIG. 7 shows the overall construction of an engine and an exhaust system thereof, and FIG. 8 is a longitudinal section view of the trap filter;

DESCRIPTION OF THE PREFERRED EMBODIMENTS

Figure 1:
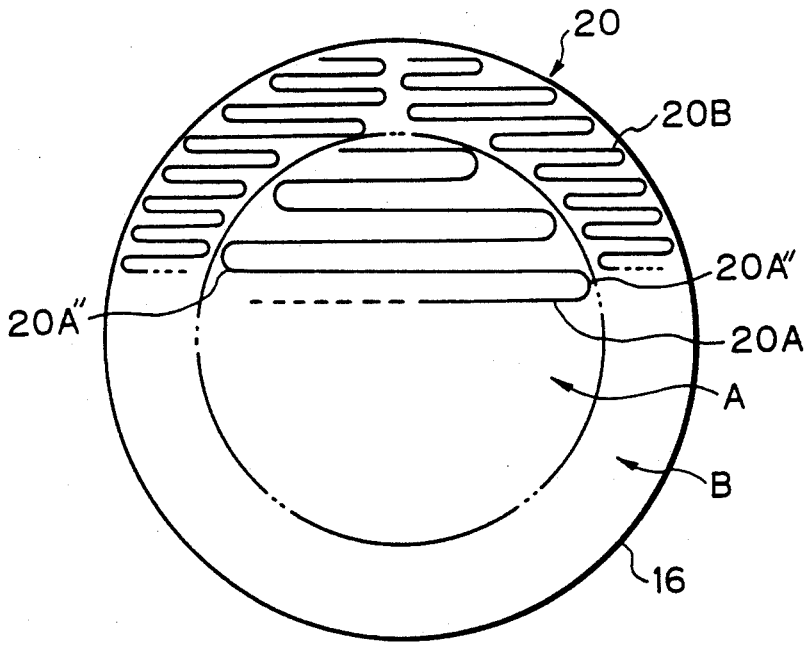
Figure 2A:
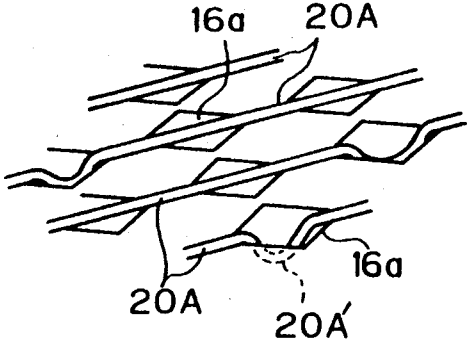
Figure 2B:
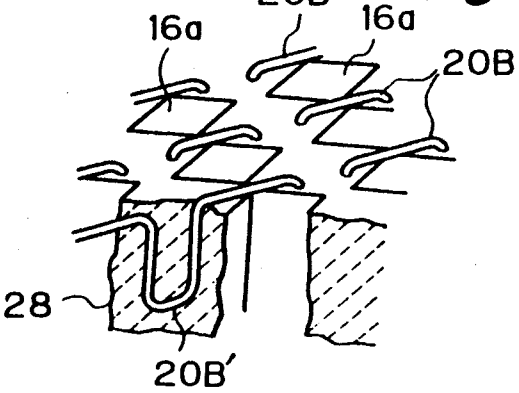
Figure 2:
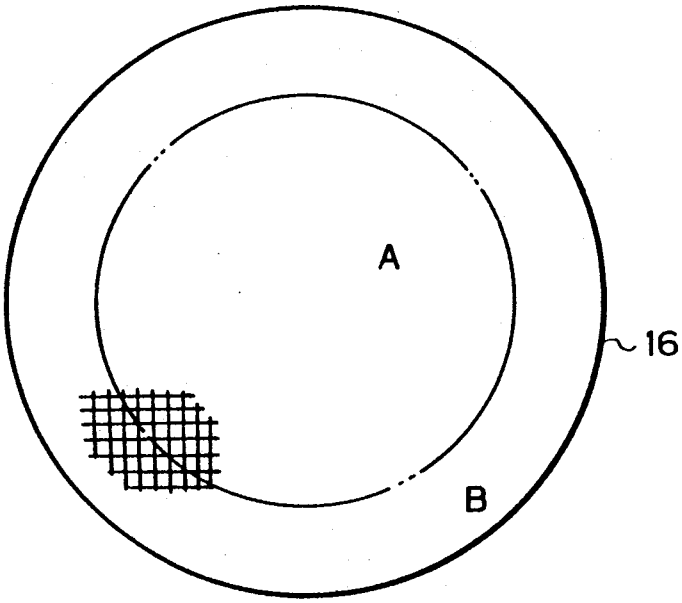

Referring to the drawings, FIGS. 1 and 2 shows the first embodiment of a particulate trap system for an exhaust gas, according to the present invention. In the shown embodiment, a particulate trap filter 16 having a circular cross-section is employed, and an electric heater 20 is provided on the upstream end face C of the filter 16. As seen, the density of the heating wires of the electric heater 20 is different at different portions of the filter 16, to thereby differentiate the amount of electric power consumed in each unit area. Namely, in the shown embodiment, a higher density of the heating wires 20B is provided in an outer circumferential portion B defined concentrically to a central portion A, than the density of the heating wires 20A in the central portion. Therefore, the power efficiency at the outer circumferential portion B is higher than that in the central portion A. In practice, as shown in FIG. 2(B), in the outer circumferential portion B, portions 20B' of the heating wire 20B are buried in upstream side plugs 28 used to plug downstream side passages defined in the filter 16, to provide a higher density. Also, as shown in FIG. 2(*a*), at the central position A of the filter 16, the heating wire 20A is fitted along the end face C of the filter 16. Since the heating wire 20A covers a wider area than that of an equivalent length of the heating wire 20B, the power consumed (equivalent to the amount of heat generated) at the unit area of the end face of the filter C is reduced. In the shown embodiment, the heating wire 20A is provided with V-shaped bent sections 20A' which are engaged with the opening end of upstream side passages, for positioning and fixing the heating wire 20A on the end face of the filter 16. Preferably such bent sections 20A' are provided at the turning portions (portions 20A'' in FIG. 1), by bending the turning portions at a right angle and bending the angled corner into the corresponding opening ends. Furthermore, when it is necessary to further firmly fit the heating wire 20A, a heat resistive inorganic bonding material can be filled in the passage, to bond the bent sections 20A'. In this case, the upstream side passages to which the bond is filled will be blocked and will not function as a filter. Nevertheless, as can be appreciated, because of the large number of upstream side passages formed in the filter 16, the blocking of some of the passages will not affect the exhaust gas flow or the filtering function of the filter overall .

Figure 3:
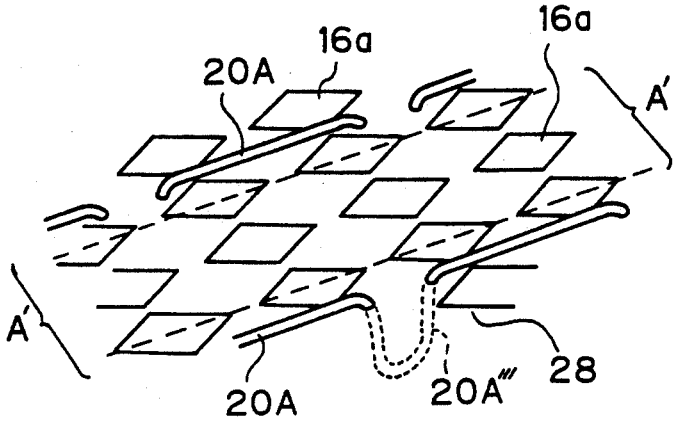
FIG. 3 is a view similar to FIGS. 2(*a*) and 2(*b*) but showing an undesirable arrangement of the heater.

When the portions 20A''' of the heating wire 20A are buried in the upstream end plug 28 of the downstream side passage, in the same way as the heating wire 20B,, the pitch of the wiring pattern must be wider than that of the heating wire 20B, to provide a lower power efficiency. In this case, the wiring pattern will become as illustrated in FIG. 3. Here, at the portion A' where the heating wire 20A is not arranged, the accumulated particulates in the vicinity of the upstream end face C are not burnt. (At the downstream portion of the filter 16, accumulated particulates are burnt, even in the passage 16*a* where the heating wire 20A is not arranged, by the heat from adjacent passages.) Therefore, the wiring pattern shown in FIG. 3 is not preferable. Namely, the wiring pattern of the heating wire 20A must be carefully arranged.

It should be noted that, although the construction shown in FIG. 3 is not preferred due to the possibility of remaining unburnt particulates during the regeneration process, an equivalent construction may be applied without causing the defects set out with respect to FIG. 3, when the depth to which the heating wire 20A is bursed is different from that of the heating wire 20B to thus achieve the desired difference in the power efficiency. To realize this, the burying depth of the heating wire 20A at the central portion A must be much less than that of the heating wire 20B in the outer circumferential portion B. Namely, by differentiating the burying depth, the desired difference of the power efficiency can be obtained without changing the pitch of the wiring pattern.

Figure 4:
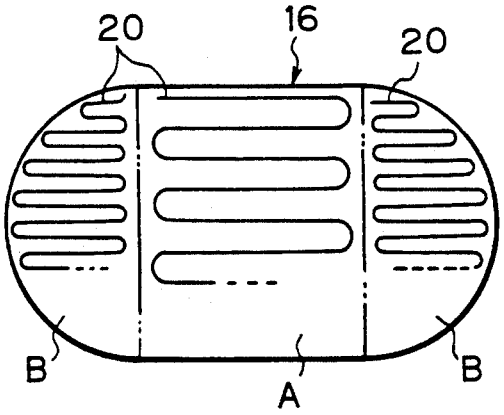
FIGS. 4 and 5 are diagram showing heater patterns according to second and third embodiment of the invention.
Figure 5:
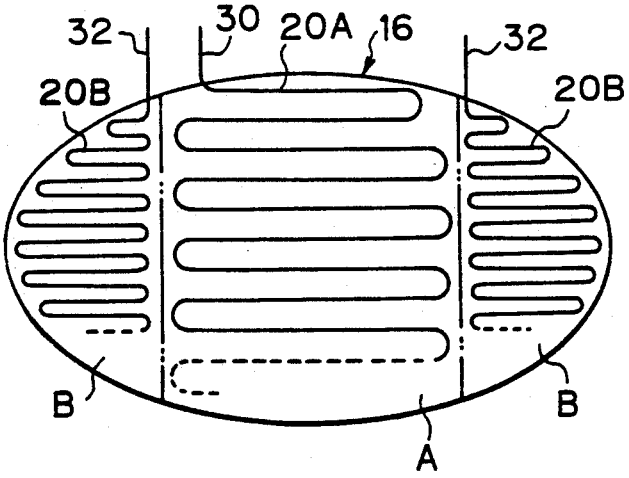

FIGS. 4 and 5 show second and third embodiments of the invention respectively. When the particulate trap system is mounted below the floor of the vehicle, it may be preferable that the cross-sectional configuration of the system be an oval or elliptic cross section, for an easier mounting thereof. In such a laterally elongated filter configuration, because of a short distance in the shorter axes direction, the cooling effect is poor even at the outer circumferential portions. In contrast, at the portion in the vicinity of the ends of the longer axes, the cooling effect is substantial not only at the outer circumferential portions but also at the portion near the central position, to possibly cause a remaining of unburnt particulates.

Therefore, in the embodiments of FIGS. 4 and 5, the heating wires 20A and 20B are arranged in a pattern such that a higher power efficiency is provided at both end portions B of the longer axes than that at the central portion A. With such a wiring pattern, the problem of unburnt particulates at the end portions B of the longer axes does not arise. Also, by the shown wiring patterns, the temperature gradient between the portions A and B can be reduced, to prevent a destruction of the filter due to a substantial thermal distortion thereof.

Furthermore, in the first embodiment (FIGS. 1 and 2), the heating wire 20A in the central portion A must extend across the outer circumferential portion B, and thus an intervention between the heating wires 20A and 20B, such as an insulation, is required. In the second and third embodiments, since the lead wires 30 and 32 can be directly extracted, the wiring is simplified.

Figure 6:
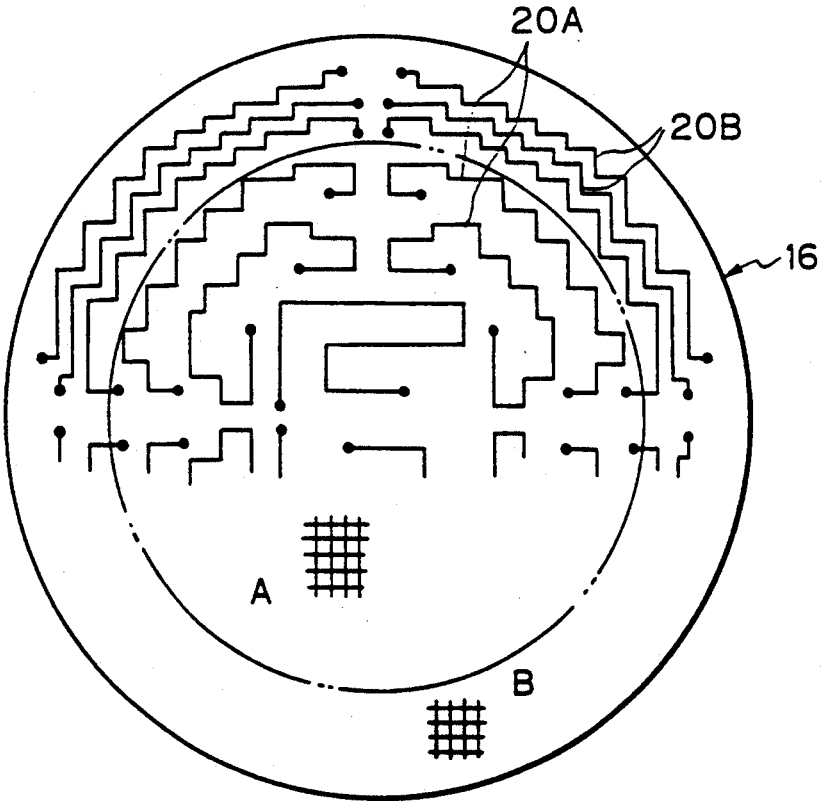
FIG. 6 is a partial enlarged perspective view of an upstream end portion of the trap filter in a fourth embodiment of the invention, in which the heater arrangement patterns are shown on an enlarged scale in FIGS. 6(*a*) and (*b*)
Figure 6A:
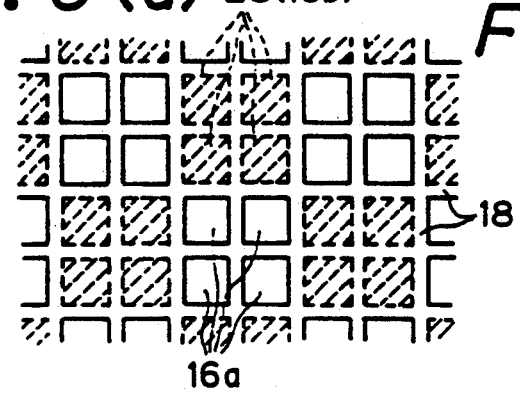
Figure 6B:
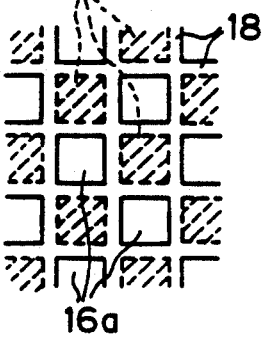
Figure 7:
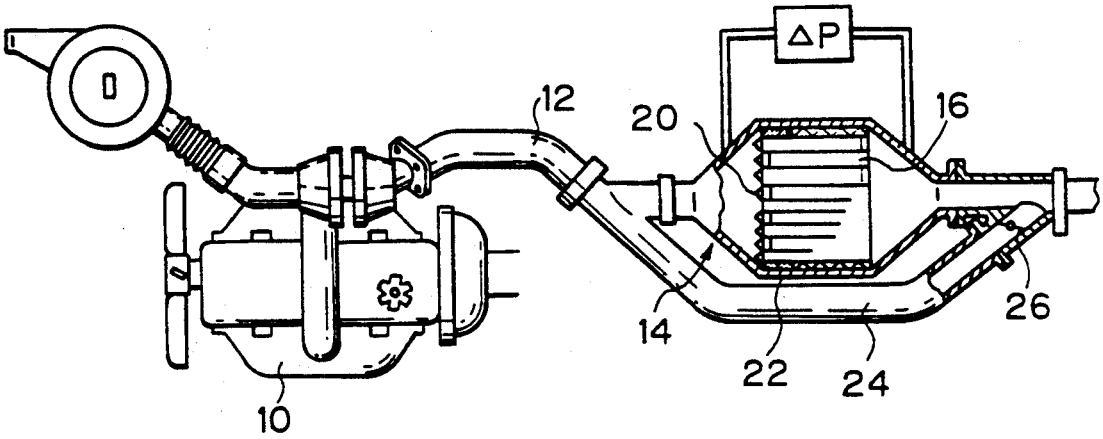
Figure 8:
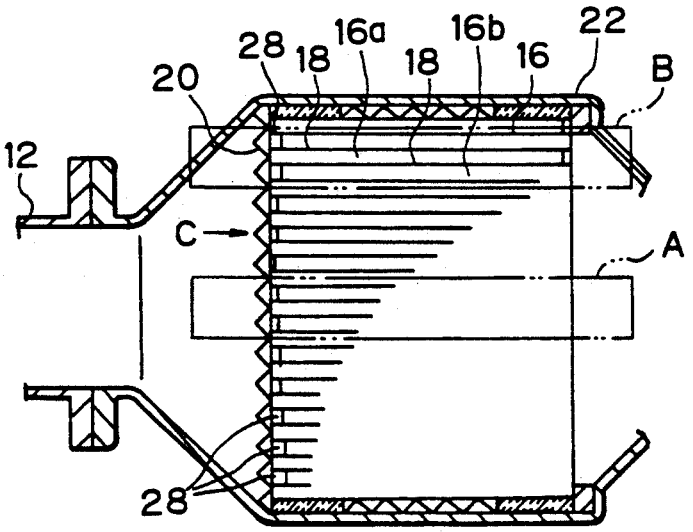
Figure 9:
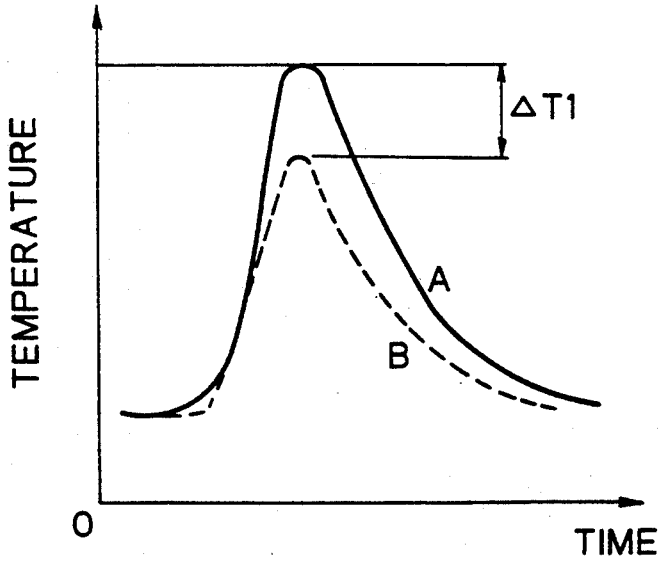
FIG. 9 is a graph showing time dependent variations of the temperatures in the filter during the regenerating treatment.

FIG. 6 shows the fourth embodiment of the particulate trap system according to the present invention, in which the plugging pattern for determining the arrangement of the upstream side passages 16*a* opening toward the upstream and the downstream side passages 16*b* opening toward the downstream is different at the central portion A and the outer circumferential portion B, to thus provide different particulate trapping performances therebetween. In this embodiment, the patterns of the heating wires are adapted to the plugging pattern. Also, in this embodiment, to provide a higher particulate trapping performance for the outer circumferential portion B, the plugs 28 are provided for every other passage as shown in FIG. 6(*b*), for arranging the upstream side passages 16*a* and the downstream side passages 16*b*. For the central portion A, the plugs 28 are provided for every four passages as shown in FIG. 6(*a*), to reduce the surface area of the porous partition 18 used for trapping the particulate. Also, to ensure a complete burning of the large amount of particulates collected in the outer circumferential portion B, a higher density of the heating wire 20B is in the arranged as shown in FIG. 6, and the heating wires 20A are arranged in the central portion A at the lower density. Such an arrangement of the heating wires, enables a good combustibility and propagation of the combustion to be obtained.

Note, the present invention can be applied to any particulate trapping filter 16, such as a known ceramic foam filter, a filter composed of steel wool coated by a porous alumina layer, or the like.

Figure 10:
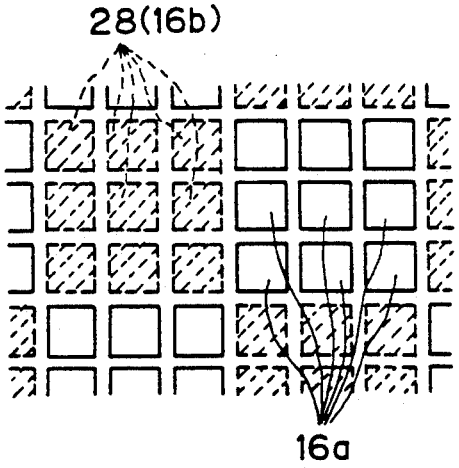
FIGS. 10 and 11 show partial enlarged perspective views of upstream end portions of the trap filters in other embodiments of the invention.
Figure 11:
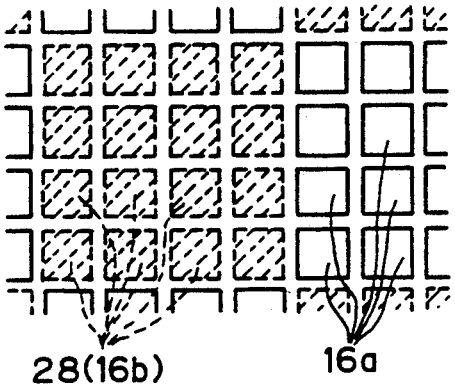

Although the present invention has been disclosed in terms of the preferred embodiment of the invention, the invention can be embodied in various ways and arrangements, for example, in above embodiment one unit of the plugging pattern of the filter has four passages as shown in FIG. 6(*a*), but in other embodiments one unit of the plugging pattern of the filter has nine or sixteen passages as shown in FIG. 10 or 11. Namely, it should be understood that all of the embodimvents and/or modifications that can be implemented without departing from the principle of the invention set out in the appended claims, should be regarded as within the scope of the present invention.

We claim:

1. A particulate trap system for an exhaust emission control comprising:

a particulate trap filter disposed within a passage of an exhaust gas of an engine, for trapping particulates carried by the exhaust gas of said engine; and an electric neater arranged at a part of said particulate trap filter for removing said accumulated particulate by burning same;

said electric heater being arranged in a pattern such that a higher power efficiency is provided at a portion away from said central position of said filter than a power efficiency provided at a central portion thereof.

2. A particulate trap system for an exhaust gas according to claim 1, wherein said portion of said electric heater having said higher power efficiency includes sections of said heating wire buried in plugs for defining said exhaust gas flow path, and said portion of said electric heater having said lower power efficiency includes sections of said heating wire bent and inserted into said inlet portion of said exhaust gas flow path.

3. A particulate trap system for an exhaust gas according to claim 1, wherein said particulate trap filter has a circular end face in which said portion of said filter located away from the center and having said portion of said electric heater providing a higher power efficiency and the portion of said filter located at the center and having said portion of said electric heater providing a lower power efficiency are arranged in an essentially concentric manner.

4. A particulate trap system for an exhaust gas according to claim 1, wherein said particulate trap filter has an oval or elliptic end face configuration, in which said portion of said filter having the portions of said electric heater providing a higher power efficiency are located at both ends along the longer axis of said filter and the portion of said filter having said portion of said electric heater providing a lower power efficiency is located therebetween.

5. A particulate trap system for an exhaust gas according to claim 1, wherein said particulate trap filter is provided with a higher particulate trapping performance at the portion away from the center and a lower particulate trapping performance at the central position by differentiating patterns for closing the passage by said plug.

6. A particulate trap filter for an emission control system comprising:

a plurality of porous partitions disposed a path for an exhaust gas from an engine and carrying particulates, said partitions defining a plurality of exhaust gas passages for passing the exhaust gas therethrough;

a first plug means for selectively closing one ends of said exhaust gas passages defined by said partitions;

a second plug means for closing the other ends of said exhaust gas passages, which are held open at said one ends, to form an exhaust gas path across said porous partitions for trapping particulates carried by the exhaust gas in said partitions; and a heating means having portions buried in said first plug means to be fixed on said one end of said exhaust gas passage for heating and burning out particulates accumulated said exhaust gas passages, the depths to which said portions of said heating means are buried being deeper at the portion of filter away from the center thereof than at the central portion.

7. A particulate trap filter according to claim 6 wherein said filter has an oval or an elliptic shaped configuration at the end face and the portion of said heating means buried to a deeper depth is located at both ends of the longer axis of said filter.

8. A particulate trap filter according to claim 6, wherein said heating means generates a higher heat capacity at the portion of said filter away from the center than that generated at said central portion.

9. A particulate trap filter according to claim 6, wherein said heating means comprises an electric heater.

10. A particulate trap filter according to claim 7, wherein said heating means comprises an electric heater.

11. A particulate trap filter according to claim 8, wherein said heating means comprises an electric heater.

* * * * *